US005931387A

United States Patent [19]

Hurley et al.

[11] Patent Number: 5,931,387

[45] Date of Patent: Aug. 3, 1999

[54] LIQUID ATOMIZER

[75] Inventors: John F. Hurley, Easton; John N. Dale, Stratford; Scott H. Lindemann, Oxford, all of Conn.

[73] Assignee: Combustion Components Associates, Inc., Monroe, Conn.

[21] Appl. No.: 08/859,616

[22] Filed: May 20, 1997

[51] Int. Cl.[6] ..... B05B 1/34

[52] U.S. Cl. ..... 239/492; 239/552; 239/556

[58] Field of Search ..... 239/490, 491, 239/492, 463, 486, 548, 552, 556

[56] References Cited

U.S. PATENT DOCUMENTS

| | | | |
|---|---|---|---|
| 995,981 | 6/1911 | Mills | 239/491 |
| 1,260,408 | 3/1918 | Leissner | 239/490 |
| 1,408,521 | 3/1922 | Lethrop | 239/490 |
| 2,577,901 | 12/1951 | Marlow | 239/492 |
| 3,669,359 | 6/1972 | Focht | 239/491 |
| 3,913,845 | 10/1975 | Tsuji | 239/556 |
| 4,087,050 | 5/1978 | Tsuji et al. | 239/490 |
| 5,106,022 | 4/1992 | Pook | 239/463 |

*Primary Examiner*—Andres Kashnikow
*Assistant Examiner*—Lisa Ann Douglas
*Attorney, Agent, or Firm*—Barry R. Lipsitz

[57] ABSTRACT

A liquid atomizer for, e.g., fuel, comprises a tube having an opening for receiving pressurized liquid flow. The tube has a closed end, a wall, and one or more bores through the wall. A shell having a discharge end with a discharge orifice encircles a portion of length of the tube, including the tube closed end. The shell forms an annular chamber around the tube end and an end chamber between the closed tube end and the shell discharge end. Liquid under pressure entering the tube opening is directed outwardly through the wall bores into the annular chamber, into the end chamber, and out through the discharge orifice for introduction, for example, into a combustor.

15 Claims, 2 Drawing Sheets

LIQUID ATOMIZER

BACKGROUND OF THE INVENTION

The present invention relates to a liquid atomizer, and more particularly to a liquid fuel atomizer for combustors.

For efficient combustion, a liquid fuel flow usually is atomized into fine droplets which burn quickly and completely in the airflow of a combustor. The atomization is accomplished by raising the liquid fuel flow to a high pressure which is then used to develop a liquid fuel flow of high swirl velocity and shearing energy. In prior art atomizers, a rapidly swirling flow is usually developed by passing the high pressure liquid feed flow tangentially and radially inwards through bores in a cylinder wall. The bores lead to a central chamber, in which the rapidly swirling flow is created. The rapidly swirling flow, upon ejection into the combustor, breaks up into a spray of fine droplets which burn readily.

Often the allowable size of the atomizer, and particularly the atomizer diameter, is limited due to physical constraints of the combustor or other apparatus in which the atomizer is used. In such cases, the atomization task is more difficult, particularly where high fuel flow capacity is needed. It would therefore be advantageous to provide a more compact atomizer for use in a combustor or the like. Such a compact atomizer should be capable of atomizing high fuel flows and using lower liquid fuel supply pressures. The present invention provides a compact atomizer having the aforementioned and other advantages.

SUMMARY OF THE INVENTION

The present invention provides an atomizer of small diameter that can atomize high fuel flows into fine droplets for rapid and complete combustion. Numerous spray patterns can be generated by the atomizer, including segmented spray patterns for, e.g., the reduction of NOx and SOx emissions. Additionally, the atomizer of the present invention uses lower fuel supply pressures than prior art atomizers in order to provide efficient atomization.

A liquid fuel atomizer in accordance with the invention comprises a tube having an opening for receiving fuel, a closed end, a wall, and at least one bore through the wall for passing fuel with a radially outward velocity component. Usually a number of bores are provided. The atomizer further comprises a shell having a discharge end with an axial fuel discharge orifice. The shell encircles a portion of length of the tube including the closed tube end, thus forming an annular chamber around the tube wall and an end chamber between the closed tube end and the shell discharge end. Fuel from the wall bores is able to pass into and flow through the annular chamber, through the end chamber, and discharge through the shell discharge orifice.

DETAILED DESCRIPTION OF THE INVENTION

Figure 1:
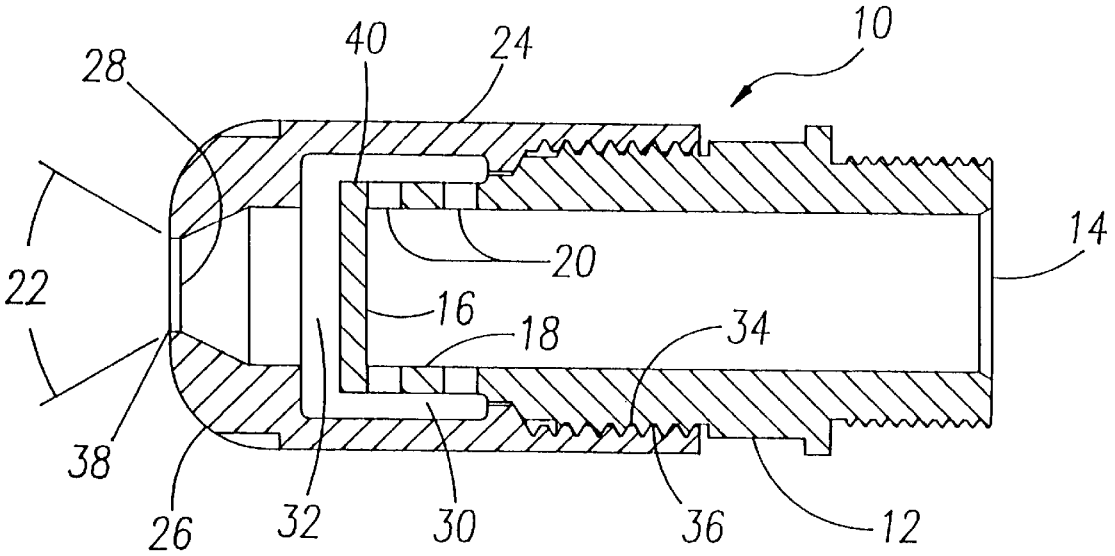
FIG. 1 is a cross-sectional view of an atomizer in accordance with the present invention.
Figure 3:
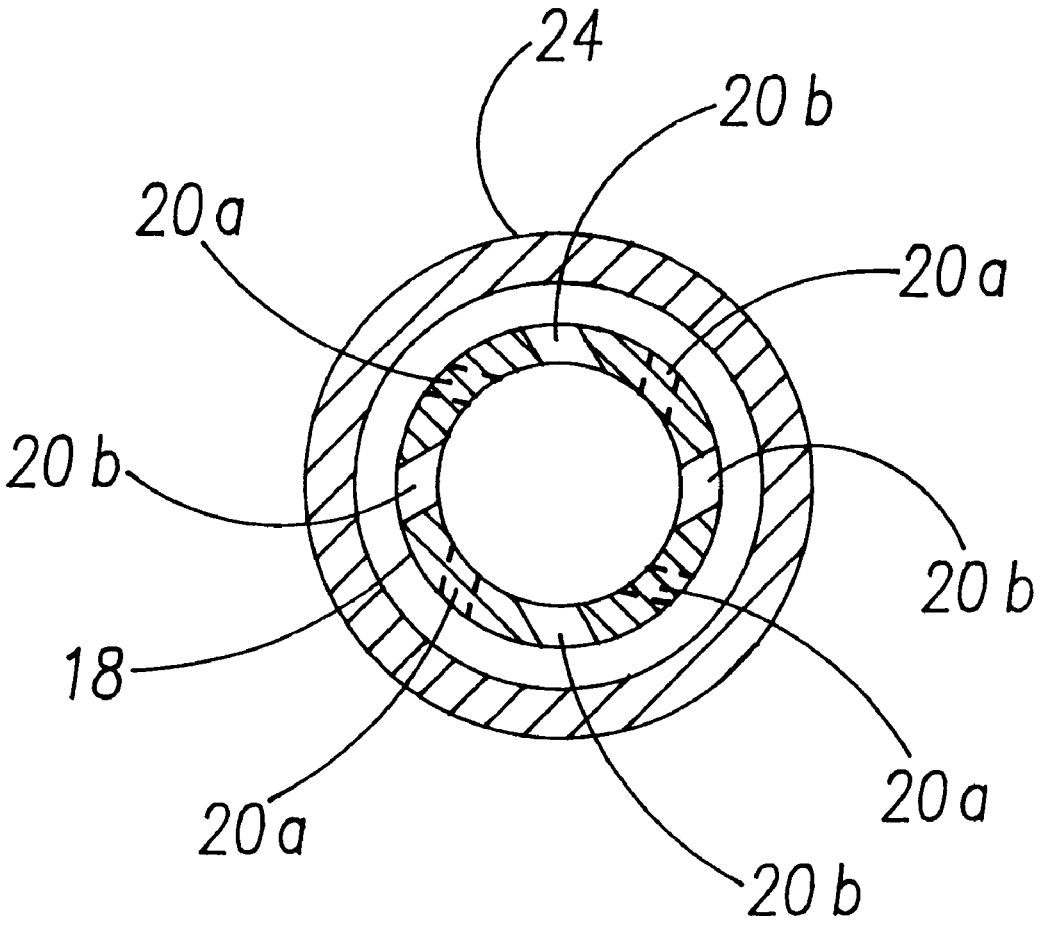
FIG. 3 is a cross-sectional view of a preferred embodiment of an atomizer in accordance with the present invention, taken perpendicularly to the atomizer axis.

With reference to FIG. 1, an atomizer 10 in accordance with the present invention comprises a tube 12 having an opening 14 for receiving a pressurized fuel flow. The tube 12 also has a closed end 16, a wall 18, and at least one bore 20 through the wall 18. In a preferred embodiment, a plurality of bores 20 is provided in a series of circumferential rows, with each row staggered relative to the preceding row. The number of bores and their location pattern are influenced by the desired fuel flow capacity of the atomizer and the spray angle 22 desired from the atomizer. Two staggered rows with bores 20*a* and 20*b*, respectively, are illustrated in FIG. 3.

A shell 24 having a discharge end 26 with a fuel discharge orifice 28 encircles at least a portion of length of the tube 12, including the closed end 16 of the tube, thus forming an annular chamber 30 around the tube end and an end chamber 32 between the closed tube end 16 and the shell discharge end 26. Thus, fuel under pressure entering the tube fuel opening 14 is directed outwardly through the wall bores 20 into the annular chamber 30, into the end chamber 32, and to discharge through the shell orifice 28.

For convenience in assembly of the tube and shell, the tube 12 may have a section of increased outer diameter with an external thread 34. The shell 24 may have an internal thread 36 whereby the shell may be screwed onto the tube external thread 34 to assemble the atomizer 10.

Preferably, the bores 20 in the tube wall are oriented radially and tangentially. With such a structure, liquid fuel passing radially outward through the bores with a high pressure drop develops a high velocity with a large radial and a large tangential component. The flow from the bores impinges on the opposed, inner wall of the annular chamber 30, forming on this surface a liquid film rotating with a high rotational speed.

The flow whirling with high rotational speed in the annular chamber 30 progresses to the end chamber 32.

Typically the discharge orifice 28 is of smaller diameter 38 than the outer diameter of the tube 12. In such an embodiment, the whirling flow develops a free vortex pattern with an inward radial flow component as it progresses to the shell discharge orifice 28. As the swirling free vortex flow progresses radially inward, its swirl velocity accelerates markedly.

The swirling flow is caused to turn axially and develops a high axial velocity to discharge from the shell discharge orifice 28. The ratio of swirl velocity to axial velocity in the discharge orifice establishes the spray angle 22, with larger ratios producing larger spray angles. The high liquid fuel velocities generated in the atomizer 10 provide high energy shearing interfaces which cause a high degree of atomization of the liquid fuel passing through the atomizer.

For spray angles of interest, which typically range from about 55 to 100 degrees, and for desirable atomization, which typically requires an average spray droplet diameter of 200 $\mu$m or less, it has been found in atomizers pursuant to this invention that the ratio of the combined flow area of the bores 20 to the product of the shell discharge orifice diameter 38 and tube outer diameter 40 is preferably in the range of about 0.2 to about 1.0. Larger spray angles are produced by smaller ratios. Various spray patterns can be generated, including segmented fuel spray patterns for reducing NOx and SOx emissions.

Figure 2:
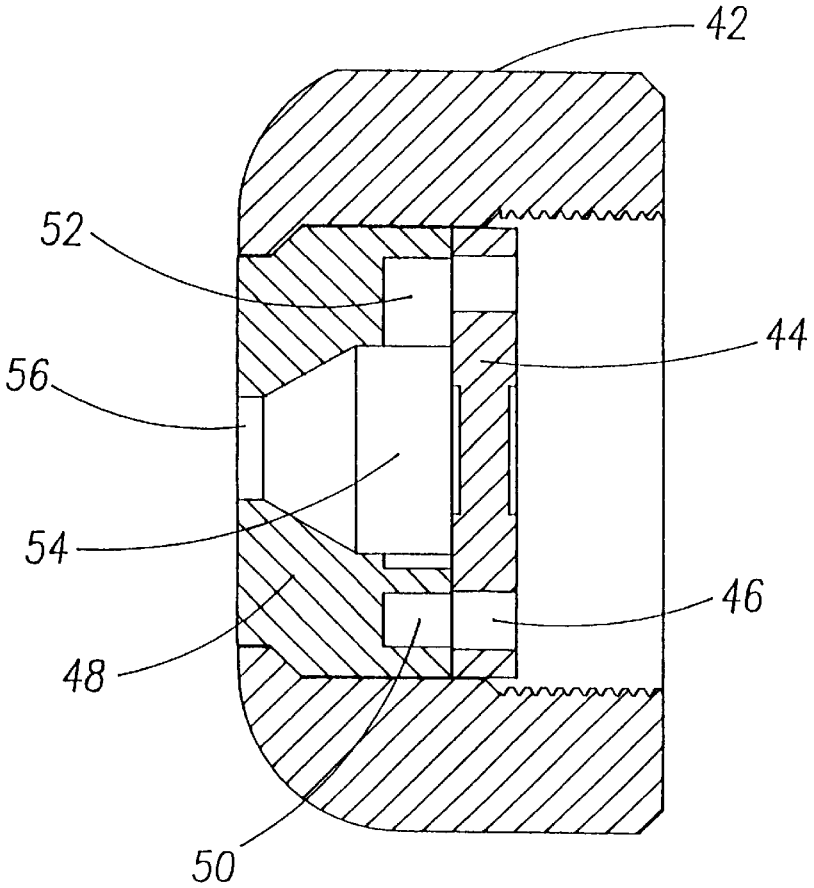
FIG. 2 PRIOR ART
FIG. 2 is a cross-sectional view of a prior art atomizer.

FIG. 2 illustrates the difference between an atomizer constructed in accordance with the present invention and prior art atomizers. In the prior art structure, liquid fuel under pressure is supplied to a cylindrical shell 42 which, at one end, retains a disk 44. The disk, near its outer periphery, has axial passages 46 for alignment with a groove 50 in a sprayer plate 48. Groove 50 is intersected by radial-tangential bores 52, which in turn lead into a cylindrical central chamber 54 that has an axial discharge orifice 56. Thus, fuel flows inwardly through the bores in the sprayer plate and then into the central chamber where a swirling flow is developed. The fuel discharges through the axial orifice into a combustor, producing a spray pattern.

Comparisons have been made of the geometry of atomizers pursuant to the present invention with the geometry of prior art atomizers. These comparisons indicate that the diameter of atomizers according to the present invention need to be only about half the diameter of prior art atomizers to achieve comparable results. Moreover, to develop adequate velocities for a degree of desired atomization, fuel supply pressures to atomizers in accordance with the present invention may be much lower than the fuel supply pressures used in prior art atomizers. Comparisons of atomizers constructed pursuant to the present invention with prior art atomizers confirms the advantages of the inventive structure. For example, an atomizer pursuant to the present invention with a diameter of less than 1.25 inches, operating at a high fuel flow capacity of 30 gpm with an inlet pressure of less than 300 psig, emits a good quality spray of less than 200 $\mu$m average droplet diameter. An atomizer pursuant to the prior art with a diameter of 2 inches, operating at a maximum fuel flow capacity of 20 gpm with an inlet pressure of 950 psig, emits a good quality spray of about 200 $\mu$m average droplet diameter.

Although the invention has been described in connection with a preferred embodiment thereof, it should be appreciated that numerous modifications and adaptations may be made thereto without departing from the scope of the following claims.

What is claimed is:

1. A liquid atomizer comprising:

a tube having an opening for receiving a liquid, said tube having a closed end, a wall, and at least two circumferential rows, each row having a plurality of bores extending through said wall and being staggered with respect to each other for continuously passing said liquid with a radially outward velocity component; and a shell having a discharge end with a discharge orifice for said liquid, said shell encircling a portion of length of said tube including said closed tube end, thus forming an annular chamber around said tube wall and an end chamber between said closed tube end and said shell discharge end, whereby liquid from said bores is able to pass into and continuously flow through said annular chamber as a liquid film rotating with a high rotational speed, through said end chamber, and discharge through said shell discharge orifice.

2. An atomizer in accordance with claim 1, wherein said tube has an outer diameter and said shell discharge orifice is of smaller diameter than said tube outer diameter.

3. An atomizer in accordance with claim 2, wherein:

said at least one bore has a combined flow area; and said shell discharge orifice has an inner diameter;

the ratio of said combined flow area to the product of said shell discharge orifice inner diameter and said tube outer diameter being in the range of about 0.2 to about 1.0.

4. An atomizer in accordance with claim 1 wherein said shell is adapted to be secured to said tube by a threaded engagement.

5. An atomizer in accordance with claim 4 wherein said tube has a section of increased outer diameter with an external thread, and said shell has an end with an internal thread adapted to mate with the external thread of said tube.

6. An atomizer in accordance with claim 1, wherein said at least one wall bore is oriented to swirl liquid passing therethrough into said annular chamber.

7. An atomizer in accordance with claim 6, wherein said tube has an outer diameter and said shell discharge orifice is of smaller diameter than said tube outer diameter.

8. An atomizer in accordance with claim 7, wherein:

said at least one bore has a combined flow area; and said shell discharge orifice has an inner diameter;

the ratio of said combined flow area to the product of said shell discharge orifice inner diameter and said tube outer diameter being in the range of about 0.2 to about 1.0.

9. An atomizer in accordance with claim 8 wherein said shell is adapted to be secured to said tube by a threaded engagement.

10. An atomizer in accordance with claim 9 wherein said tube has a section of increased outer diameter with an external thread, and said shell has an end with an internal thread adapted to mate with the external thread of said tube.

11. A method for atomizing a liquid comprising the steps of:

supplying pressurized liquid into a tube having a side wall with at least two circumferential rows each having a plurality of bores extending therethrough and being staggered with respect to each other;

continuously passing said pressurized liquid from said tube through said bores into an annular chamber thereby forming a liquid film rotating with a high rotational speed;

passing said liquid from said annular chamber into an end chamber; and discharging liquid through an orifice in said end chamber.

12. A method in accordance with claim 11 wherein said tube has an outer diameter; and the orifice in said end chamber is of smaller diameter than said tube outer diameter.

13. A method in accordance with claim 12 wherein:

said at least one bore has a combined flow area; and the orifice in said end chamber has an inner diameter;

the ratio of said combined flow area to the product of said orifice inner diameter and said tube outer diameter being in the range of about 0.2 to about 1.0.

14. A method in accordance with claim 13 wherein said at least one bore is oriented to swirl liquid passing therethrough into said annular chamber.

15. A method in accordance with claim 11 wherein said at least one bore is oriented to swirl liquid passing therethrough into said annular chamber.

* * * * *